US007444789B1

(12) United States Patent
Moore

(10) Patent No.: US 7,444,789 B1
(45) Date of Patent: Nov. 4, 2008

(54) INSULATED CONCRETE FORM HOLDER

(76) Inventor: Daniel W. Moore, 4709 Rt 46 S., Jefferson, OH (US) 44047

( * ) Notice: Subject to any disclaimer, the term of this patent is extended or adjusted under 35 U.S.C. 154(b) by 587 days.

(21) Appl. No.: 11/079,609

(22) Filed: Mar. 14, 2005

(51) Int. Cl.
*E04B 2/00* (2006.01)

(52) U.S. Cl. ..... 52/426; 52/699; 52/293.1; 52/741.13; 52/404.1; 249/33

(58) Field of Classification Search ..... 52/426, 52/415, 416, 418, 431, 443, 699, 293.1, 293.4, 52/294, 564–565, 404.1, 404.2, 741.13, 741.15, 52/742.14, 309.11, 712, 714, 715, 677; 249/33–36, 249/40, 44–46, 216, 219.1
See application file for complete search history.

(56) References Cited

U.S. PATENT DOCUMENTS

| | | | | |
|---|---|---|---|---|
| 4,612,744 | A | 9/1986 | Shamash | |
| 4,879,855 | A * | 11/1989 | Berrenberg | 52/309.11 |
| 4,884,382 | A * | 12/1989 | Horobin | 52/426 |
| 5,086,600 | A | 2/1992 | Holland | |
| 5,103,613 | A | 4/1992 | Kinoshita | |
| 5,367,845 | A | 11/1994 | Hartling | |
| 5,475,950 | A * | 12/1995 | Palmer | 52/169.5 |
| 5,555,698 | A | 9/1996 | Mandish | |
| 5,657,600 | A * | 8/1997 | Mensen | 52/426 |
| 5,924,254 | A | 7/1999 | Franklin | |
| 5,937,604 | A * | 8/1999 | Bowron | 52/426 |
| 6,016,633 | A * | 1/2000 | Elwart | 52/294 |
| 6,170,220 | B1 * | 1/2001 | Moore, Jr. | 52/741.13 |
| 6,240,700 | B1 * | 6/2001 | Sheu | 52/741.13 |
| 6,347,489 | B1 | 2/2002 | Marshall | |
| 6,488,257 | B2 | 12/2002 | McSwain | |
| 6,540,201 | B1 | 4/2003 | Gagnon | |
| 6,609,340 | B2 * | 8/2003 | Moore et al. | 52/309.11 |
| 6,622,439 | B2 | 9/2003 | Moreno | |
| 6,698,710 | B1 | 3/2004 | VanderWerf | |
| 6,922,962 | B2 * | 8/2005 | Schmidt | 52/426 |
| 6,990,774 | B2 * | 1/2006 | Clapp | 52/294 |
| 2002/0078649 | A1 | 6/2002 | Clapp | |
| 2003/0074857 | A1 | 4/2003 | Clapp | |

OTHER PUBLICATIONS

American Polysteel, Inc., Forms for Concrete User Manual, Fourth Edition, 1999 Published by American Polysteel, Inc. 5150-F Edith NE Albuquerque, New Mexico 87107.

* cited by examiner

*Primary Examiner*—Richard E. Chilcot, Jr.
*Assistant Examiner*—Mark R Wendell

(57) ABSTRACT

An insulated concrete form holder is provided for holding insulated concrete forms that form the first course of a wall so that the first course of insulated concrete forms are formed integrally with the foundation of a building. The form holder has a support surface for supporting the form holder in a foundation form and a form support surface for contacting the bottom of the insulated concrete form and supporting the insulated concrete form thereon. The form support surface is positionable between the top and the bottom of the foundation form, said form support surface is spaced from the top of the foundation form a distance less than the height of the insulated concrete form so that the top of the insulated concrete form is positionable above the top of the foundation form. The form holder includes form support upright portions extending upwardly from the form support surface for contacting the sides of the insulated concrete form and restraining lateral movement of the insulated concrete form.

25 Claims, 6 Drawing Sheets

INSULATED CONCRETE FORM HOLDER

TECHNICAL FIELD

This invention generally relates to building construction using concrete or other pourable, hardenable materials. More particularly the present invention relates to the use of concrete form holders to position insulated concrete forms when pouring concrete to form the footer and walls of a building.

BACKGROUND OF THE INVENTION

The present invention is directed to a method and apparatus for positioning insulated concrete forms when forming the building footer or base and the walls of a building.

The use of cements and concretes as structural materials to construct a building is well known. For example, cements and concretes may be used to form footers, walls, floors and other structural elements of a building. Cement and concrete materials may be formed in a wide variety of shapes and forms since they may be provided in a liquid, semi liquid, or slurry state and poured into a form where they harden and cure in place to form a permanent structural element. The strength of the concrete element may be readily increased with the use of readily available reinforcing elements, such as metal bars and mesh. The reinforcing elements are positioned in the form prior to pouring the cement into the form so that the reinforcing elements become part of the permanent structural cement element.

A wide variety of concrete forms have been used. Perhaps the most commonly used form is made of wood, metal or a combination of those materials. For example, when pouring a footer, which supports a building, a trench is dug around the outer perimeter of the building to be constructed. Forms are then positioned in the trench so that they extend upwardly from the bottom of the trench to receive the concrete slurry between the forms where the concrete may harden. Before pouring the concrete into the footer form, the forms are carefully leveled so that the top of the footer is level and provides a surface on which the walls of the building may be constructed.

After this leveling process, the forms are secured in position to resist movement of their forms when the concrete is poured into and worked between the forms. A variety of devices may be used to secure the forms in position such as stakes, metal tie plates, or metal tie rods between the opposing forms. Reinforcing elements such as metal bars, are then positioned between the opposing forms and spaced upwardly from the bottom of the trench to impart additional strength to the footer. One known reinforcing rod support is a pyramid shaped wire form with the base resting on the bottom of the trench and the apex holding the reinforcing bar at a specific distance above the bottom of the trench. After the cement is poured, and while in a liquid or semi liquid state, the cement is worked to avoid air pockets within the footer and also provide a smooth and level upper footer surface.

The top of the footer is defined by the upper footer surface and provides for supporting the walls of the building. A common construction technique is to construct a concrete block wall on the top of the footer. Another construction technique is disclosed in Gagnon, U.S. Pat. No. 6,540,201, which provides for a tilt up concrete panel forming system. A concrete wall is preformed and a base strip is positioned on the supporting surface and the preformed concrete wall is then tilted up into position and held in that position by the brackets and the base strip.

Mandish, U.S. Pat. No. 5,555,698, provides a building panel having a mesh surface for supporting a lightweight concrete coating with the building panel filled with insulation material. Shamash, U.S. Pat. No. 4,612,744, utilizes a buried anchoring pod and pilings extending upwardly from the pods for supporting the building. The walls of the building are formed by a concrete poured into a plastic U-shaped base member with wall panels extending upwardly from the base member. When concrete is poured into the base member and wall panels, the wall of the building is formed.

Another building technique is described in Franklin, U.S. Pat. No. 5,924,254. Franklin describes the use of the modular construction system using wall units of precast concrete which are stacked on the top of the footer to create a wall. The wall units receive reinforcing bar extending upwardly from the top of the footer and a spacer/tensioning assembly is provided. Grout is then poured into the vertically and horizontally extending passages of the wall unit to create a monolithic wall.

Yet another wall forming system is described in VanderWerf, U.S. Pat. No. 6,698,710, which provides for the use of panels, including insulating foam panels, and substantially rigid panels of wood, plastic, polymeric composites, cementitious composites of foam, fibers, metal and other such materials, many of which provide additional insulating properties. Wall tie rail and corner tie rail components and other such components are provided to form wall sections for mounting on the footer.

An alternative to wall forming systems using conventional wood and metal forms, provides for the use of preformed expanded polymeric foam forms, commonly referred to as Insulating Concrete Forms or "ICF". While there are many types of ICF forming systems, in general, hollow blocks or panels molded or manufactured from low density polymeric foam materials are positioned on the foundation or footer and stacked vertically to form a wall or a portion of a wall. Liquid concrete or cement is poured into the hollow portions of the ICF blocks or panels to form a wall or portion of a wall. After the concrete hardens, the ICF blocks or panels are left in place and provide enhanced insulating for the building walls, reduced moisture passage through the walls, provide a substrate into which utility lines and typing can be installed and provide a service for the attachment of finishing materials.

One ICF is described in Berrenberg, U.S. Pat. No. 4,879,855, and has a central portion of expanded webbed steel with its opposite sides terminating in metal strips. The Berrenberg ICF is formed from an expanded polymeric foam, such as polystyrene, with the expanded webbed steel extending between the outside surfaces of the ICF. The metal strips are provided on the outside surfaces of the ICF to provide for attaching finishing materials to the outer surfaces of the ICF. In facilitating the construction of a building, a footer is poured and allowed to hardened with a flat and level top. When pouring a footer it is difficult to maintain the top of the footer level around the periphery of the building. When there are slight variances in the level of the top of the footer some portions will be higher than other portions.

The top of the footer is then cleaned and polyurethane foam adhesive is applied to the bottom of the ICF form. The bottom of the ICF form is then positioned on and secured to the top of the footer with the polyurethane foam adhesive. On occasion, the ICF form shifts or moves while it is being secured to the top of the footer with adhesive and the wall is misaligned. The variances in the level of the top of the footer allow for variances in the level of the ICF forms. Any slight shifting of the ICF forms when they are secured to the top of the footer also allow further variances. Additional ICF forms are secured to the bottom ICF forms attached to the top of the footer and the variances in the level of the ICF forms are continued and may be accentuated.

Alternatively, the ICF forms may be set on the footer when the footer concrete is wet. This technique of positioning the first course of ICF forms requires constant adjustment to level the forms while also maintaining them in alignment along the wall. Since the concrete is still in a fluid or semi fluid state it is difficult to properly change and adjust the alignment and level of the entire bottom course of the ICF forms.

Another alternative in mounting the ICF forms to the top of the footer includes the use of steel brackets made from sheet metal. The steel brackets are mounted on the top of the footer with the ICF form glued to the top of the footer with its alignment maintain by the steel brackets.

While the ICF form described in Berrenberg is used herein in describing the present invention, it should be understood that any other ICF form may be used in conjunction with the present invention.

For example, Hartling, U.S. Pat. No. 5,367,845, describes another ICF form with a footing block system and a wall form system. The footing block system provides opposing shells of expanded polymeric foam for forming a footer. The wall form system provides for the use of ICF block forms positioned on the footing block system with complex geometry to interlock the components of the both the wall and footing form systems. Hartling also provides a reinforcing bar support in the footing block system. Holland, U.S. Pat. No. 5,086,600, provides interlocking surfaces on the blocks for maintaining alignment between the blocks.

It is desirable to provide a building using ICF forms with at least the first course of ICF's formed integrally with the footer so as to avoid movement of the ICF forms on the top of the footer which would create misalignment of the walls formed by the ICF forms. Furthermore, by forming at least the first course of ICF's integrally with the footer, the level and alignment of the first course of concrete forms is accomplished without requiring the precise leveling and alignment of the footer.

It is also desirable to provide a building using ICF forms which minimizes the possibility of water leakage between the bottom course of the ICF forms and the footer. By minimizing such leakage, the likelihood of water flowing inside the basement or the inside of the ICF forms is decreased.

An important factor in constructing a building is the cost of construction. Labor constitutes a substantial cost in constructing a building. The placement of ICF forms using known construction techniques is labor-intensive when properly aligning the ICF forms on the top of the footer and also assuring that they are level through out the length of the wall or walls to be formed by the ICF forms.

When the bottom of the ICF form is positioned on and secured to the top of the footer with polyurethane foam adhesive, if differing thicknesses of adhesive are placed on the bottom of the ICF form, the ICF form may be tilted or canted in a variety directions and not be properly aligned with each other or the footer. Also, even if a consistent amount of polyurethane foam is applied to the bottom of the ICF form, if a greater amount of pressure is exerted on one portion of the ICF form when positioning it on the top of the footer, the ICF form will be tilted or canted. Any slight shifting of the ICF forms when they are secured to the top of the footer also allow further variances. This construction technique requires substantial labor in aligning the ICF forms along the top of the footer and also placement of the ICF forms so they are not canted or tilted with respect to the top of the footer. Resolving these numerous variables is labor intensive.

Another known construction technique in the placement of ICF forms on the footer, is to set the ICF forms on the top of the footer when the footer concrete is wet. This technique of positioning the first course of ICF forms requires constant adjustment to level the forms while also maintaining them in alignment along the wall. Since the concrete is still in a fluid or semi fluid state is difficult to properly change and adjust the alignment and level of the entire bottom course of the ICF forms. Once again, this technique requires substantial labor.

Yet another known construction technique in the placement of ICF forms on the top of the footer is to mount steel brackets on the top of the footer with the ICF form glued to the top of the footer with the alignment of the ICF form maintained by the steel brackets. This construction technique requires the proper positioning of the steel brackets on the top of the footer and then securing the brackets to the footer by threaded fasteners and the like. If the top of the footer is not level, the brackets are not level and must be leveled, such as by the use of shims or the like, before the ICF forms are positioned on the top of the footer.

Further, it is desirable to provide for the use of ICF forms of different sizes. This allows the building wall to be formed in different thicknesses and configurations depended on the requirements of each specific structure or building.

BRIEF SUMMARY OF THE INVENTION

The present invention provides an insulated concrete form holder for holding the insulated concrete forms forming the first course of a wall so that the first course of insulated concrete forms are formed integrally with the foundation of the building.

In general, an insulated concrete form has a bottom, opposing sides and ends, and a top spaced from the bottom a predetermined form height distance. The building has a foundation, such as a base or footer to support the first course of the insulated concrete forms and the wall of the building. Additional insulated concrete forms are constructed on top of the first course.

For ease of description, it should be understood that the base or footer or foundation of the building has a wide variety of constructions and designs and that the invention will be described in connection with one particular type of footer or base with the understanding that the present invention can be used in conjunction with various foundations including footers or bases. The foundation form is provided along the length of the wall of the building to be constructed. The foundation form may be of metal, wood, plastic, earth or other building materials to constrain the concrete as it is poured into the foundation form and as a bottom and opposing sides which extend upwardly to a top which is spaced from the bottom of the footer for a predetermined foundation depth distance. In one embodiment, channel shaped drains define the sides of the footer form with the bottom of the form defined by the bottom of a trench in which the channel shape drains are positioned.

The insulated concrete form holder of the present invention, includes a support surface for supporting the holder in the foundation form. The support surface may contact any fixed surface, such as the top, bottom, or sides of the foundation form or any other fixed surface or structure.

To position the insulated concrete forms, which form the first course of a wall so they are formed integrally with the foundation, the form holder has a form support surface for contacting the bottom of the insulated form. The form support surface is positioned between the top, bottom and sides of the foundation form. The form support surface is spaced from the top of the foundation form a distance less than the height of the insulated concrete form so the top of the insulated concrete form is positioned above the top of the foundation. Additional insulated concrete forms may be positioned on the top of the insulated concrete forms forming the first course of the wall.

The form holder also includes form support upright portions which extend upwardly from the form support surface. These upright portions have form retaining surfaces extending upwardly from the form support surface for contacting the opposing sides of the insulated concrete form. The form restraining surfaces are releasably secured to the insulated concrete form with a fastening device, such as threaded fasteners or the like, to hold the insulated concrete forms in position.

Insulated concrete forms may have varying widths so to accommodate these varying widths, the form support upright portions are movable with respect to each other. When a wide insulated concrete form is used, the upright portions are positioned on the form support surface so that the insulated concrete form is positioned between the upright portions and the sides of the insulated concrete form are in contact with the upright portions. At least one of the upright portions are releasably secured to the form support surface and the insulated concrete forms are releasably secured to the upright portions. Accordingly, the insulated concrete forms are positioned in the foundation form with their movement restrained. It should be understood that when insulated concrete forms of a smaller width are used, the upright portions are positioned closer to each other before being secured into the form support surface. The upright portions are adjustable to accommodate various sizes of insulated concrete forms.

In many instances it is desirable to reinforce the foundation with a various reinforcement materials, such as reinforcement metal bars, commonly known as "rebar". Known construction techniques provide for positioning the rebar a predetermined distance above the bottom of the foundation and holding it in place while concrete is poured and hardens to form the foundation. The present invention provides for supporting the rebar on a bar support surface which is spaced above the bottom of the foundation and below the form support surface. In order to further restrain movement of the rebar, the present invention provides reinforcing bar upright portions extending upwardly from the bar support surface for receiving a reinforcing bar therebetween.

In order to form the first course of a wall so that the first course of insulated concrete forms are formed integrally with the base or footer or foundation of the building, the insulated concrete form holders of the present invention are positioned in the foundation form along the length of the foundation and wall to be poured. It should be understood that a number of insulated concrete for holders will be positioned along the foundation form. Rebar is then positioned on the bar support surface of the form holders in between the reinforcing bar upright portions. The form support upright portions are then positioned on the form support surface so the insulated concrete forms may be received therebetween. The forms for upright portions are then secured to the form support. The insulated concrete forms are then positioned and supported by the form support surface with the top of the form positioned above the top of the foundation form. Care is taken to make sure that the top of the insulated concrete forms are level and in alignment with each other. Other reinforcing members may also be positioned inside the insulated concrete form in the foundation. The concrete is then poured into the foundation and insulated concrete forms. The concrete is then "worked" to avoid air pockets and then allowed to hardened and cure.

Since the insulated concrete forms are formed integrally with the foundation, the likelihood of leakage of water between the wall and the foundation is decreased. In addition, by forming the insulated concrete forms integrally with the foundation, movement of the ICF forms on the top of the footer which would create misalignment of the walls formed by the ICF forms is avoided. The present invention allows for continuous wall construction usually within hours of the initial pouring of the footers and the first course of insulated concrete forms or soon after the concrete therein has set, thus saving time and expediting the construction process.

The present invention avoids the multiple leveling processes of leveling the foundation, leveling and aligning the insulated concrete forms on the foundation and also making sure the tops of the insulated concrete forms forming the first course are in alignment with each other. In addition, the present invention provides for the use of insulated concrete forms of a wide variety of constructions and designs.

DETAILED DESCRIPTION OF THE INVENTION

Figure 1:
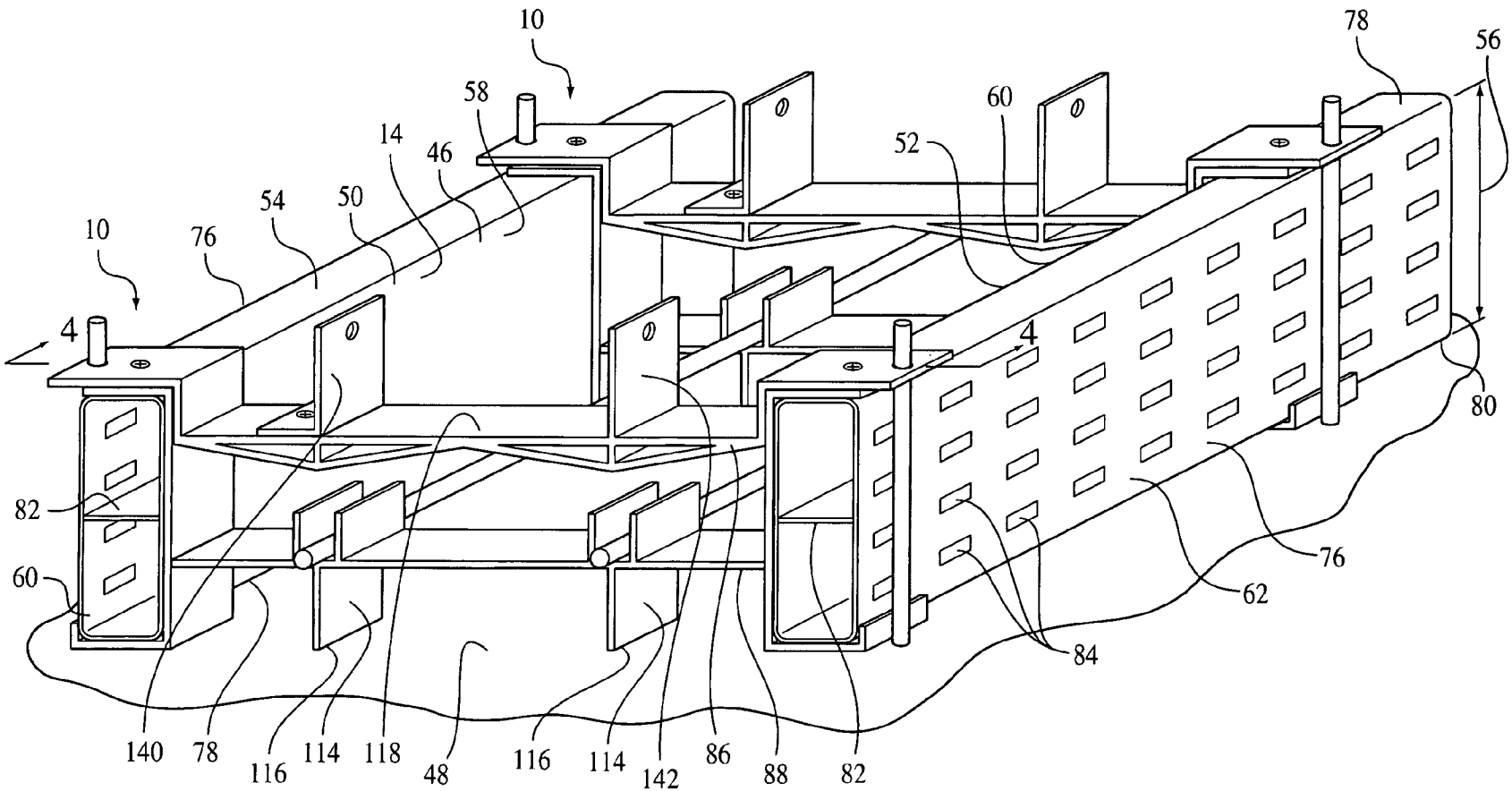
FIG. 1 is a perspective view of several form holders of the present invention having top and bottom members mounted along a drain member, which also functions as a portion of a foundation form, on each side with rebar and insulated concrete forms in place.
Figure 4:
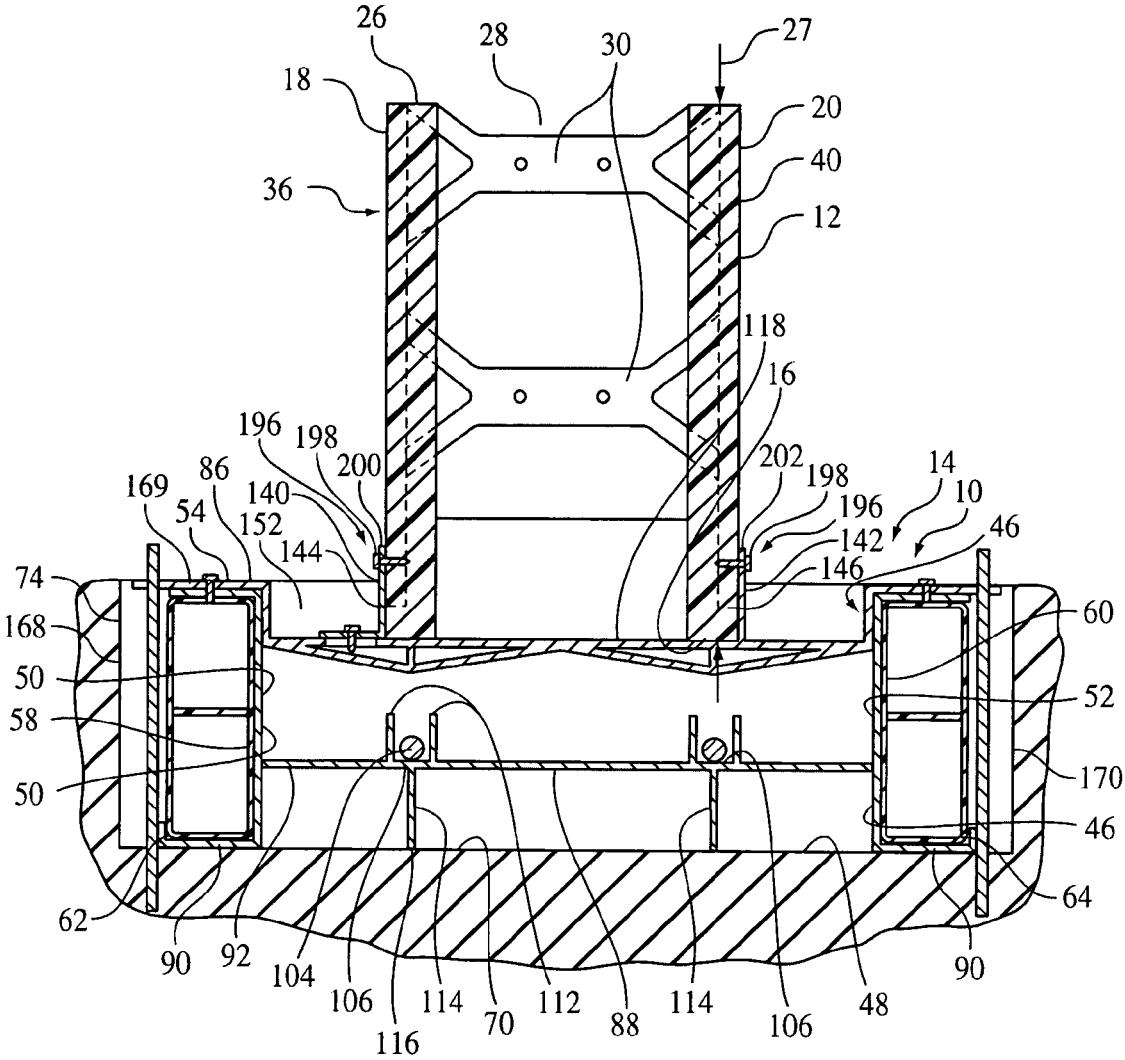
FIG. 4 is an end sectional view taken along the line 4-4 in FIG. 1.
Figure 7:
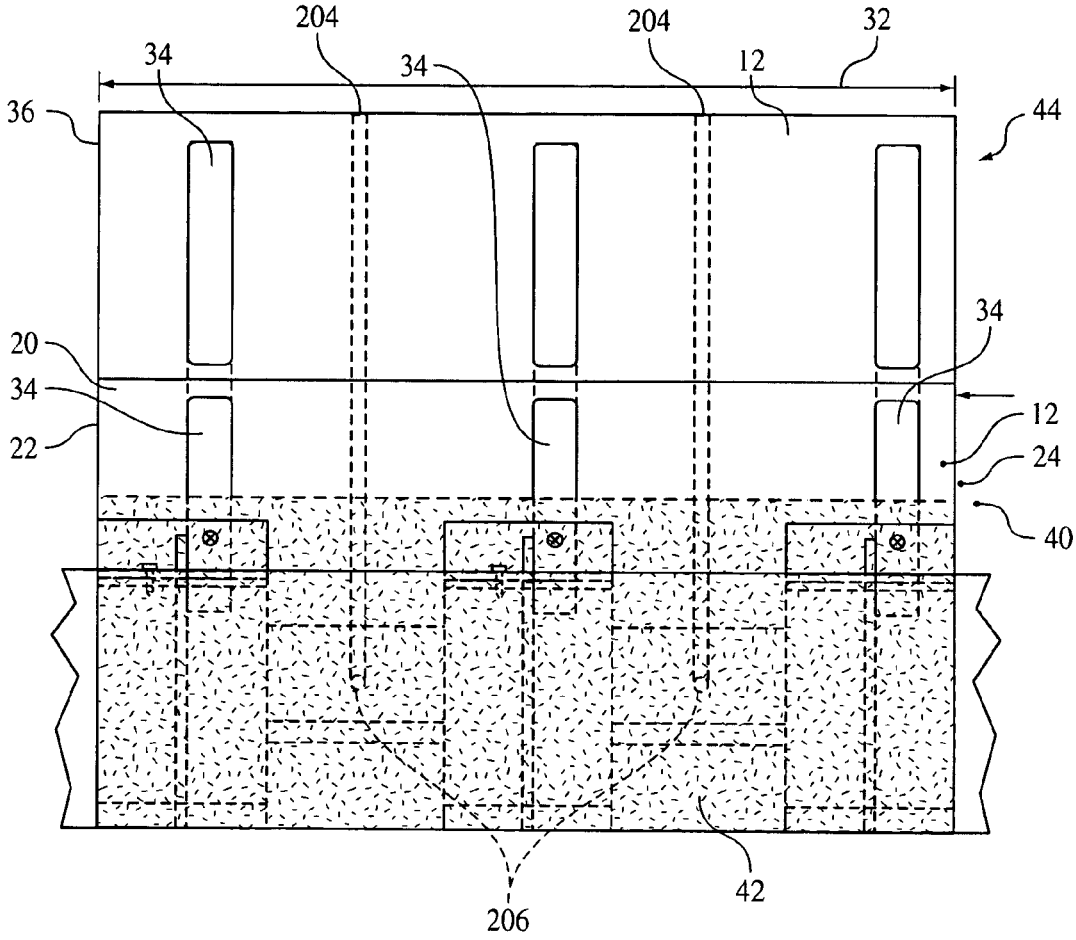
FIG. 7 is a side view of FIG. 1 showing the concrete foundation poured in place with concrete covered components shown in dashed lines.

The present invention provides an insulated concrete form holder 10 for positioning an insulated concrete form (ICF) 12 in a foundation form 14, as shown in FIGS. 1, 4 and 7. The insulated concrete form 12 may be of a wide variety of constructions and designs which generally provides a preformed expanded polymeric foam form into which concrete may be poured. These ICF's are designed to fit together so that when they are filled with concrete and the concrete hardens and cures, a wall or several interconnecting walls are formed. While the ICF 12 as shown in the drawings is of one construction and design, it should be understood that it is within the contemplation of this invention to use the form holder 10 with any insulated concrete form. It should also be understood that the term concrete includes a wide variety of concretes, cements and the like materials that may be provided in a liquid, semi liquid, or slurry state and poured into a form where they harden and cure in place to form a permanent structural element.

Figure 5:
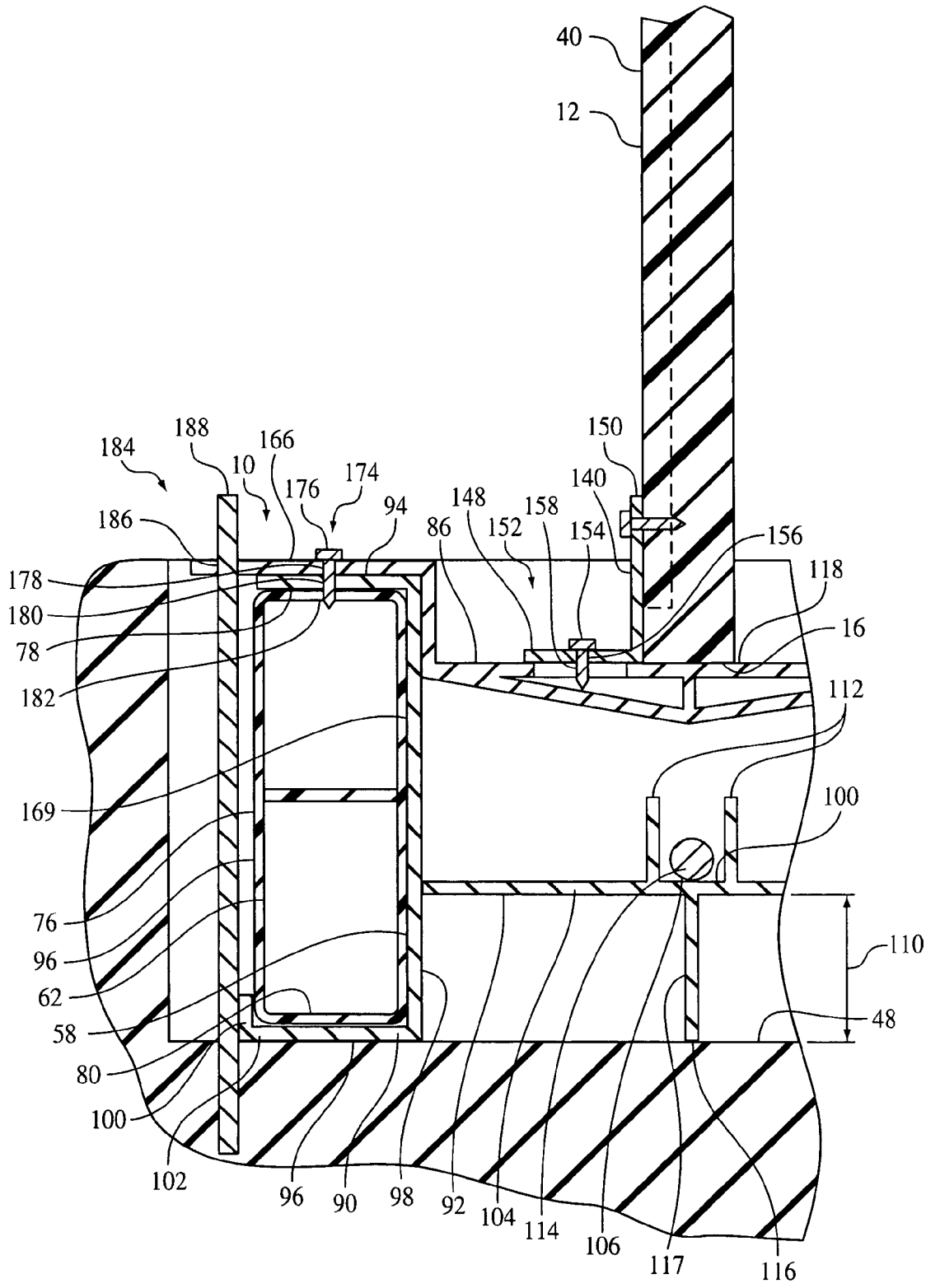
FIG. 5 is an enlarged view of a portion of FIG. 4.
Figure 6:
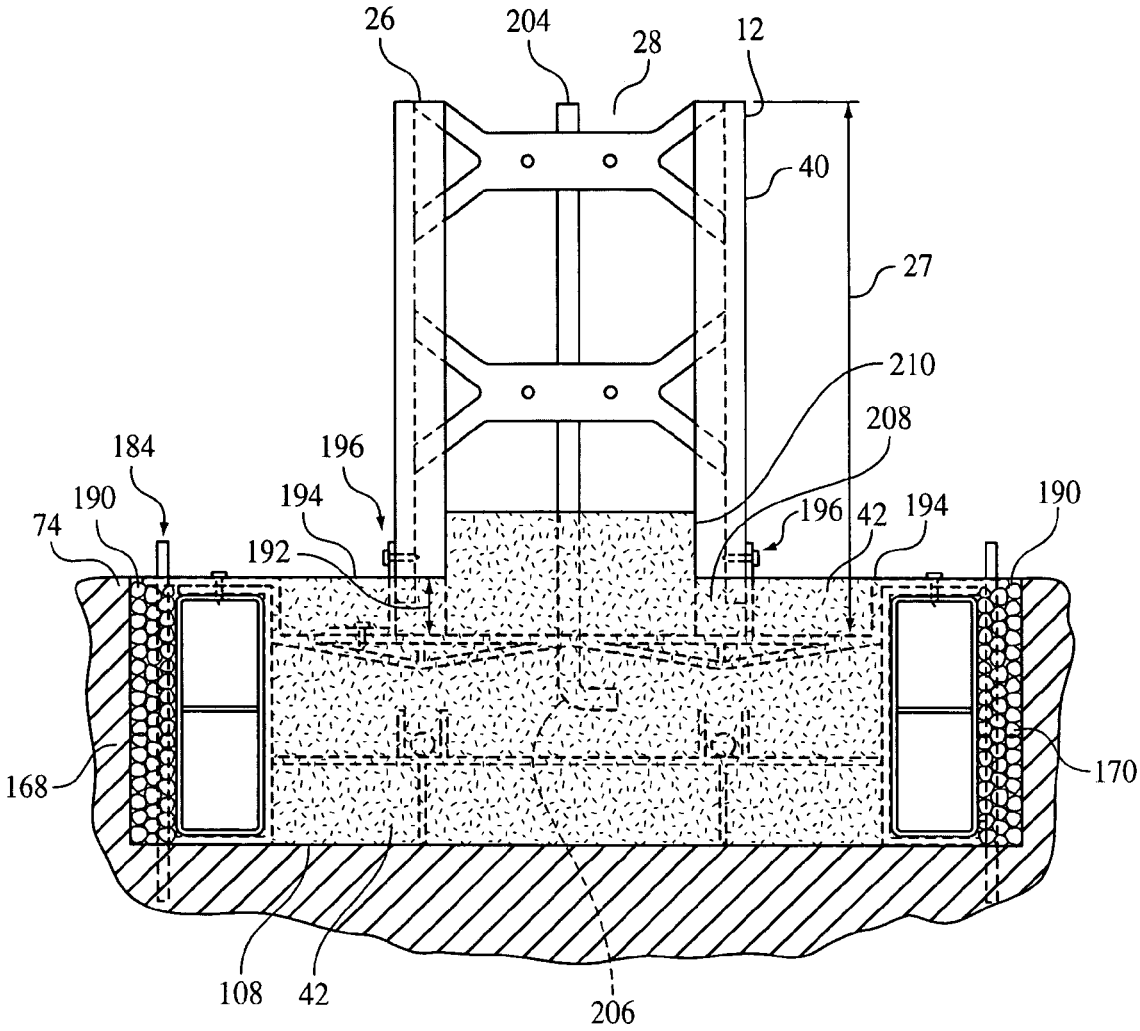
FIG. 6 is an end sectional view shown in FIG. 4 with the concrete foundation poured in place with concrete covered components shown in dashed lines.

The insulated concrete form 12 has a bottom 16, opposing sides 18, 20, opposing ends 22, 24 and a top 26. The top 26 is spaced from the bottom 16 a predetermined form height distance 27. An aperture 28 is provided in the ICF 12 with metal or plastic reinforcing mesh 30 extending across the aperture 28 at various locations along the length 32, shown in FIG. 7, between the ends 22, 24. of the ICF. The mesh terminates in mounting strips 34 on the opposing sides 18, 20 of the ICF to allow additional construction components to be attached thereto as shown in FIGS. 4-6. The mesh is also provided to improve the strength of the wall formed by concrete in the aperture 28 as will be hereafter more fully described. The ICF's 12 are formed to fit together to form a wall 36 or a series of contiguous walls of a structure 38. When the ICF's 12 are fitted together, their apertures 28 are contiguous and concrete may flow through the contiguous apertures. The concrete is then allowed to harden and cure to form the wall or walls 36. Such walls having an inner core of concrete in the apertures 28 which are reinforced by the mesh 30 and inner and outer sides 18, 20 of expanded polymeric foam.

The present invention provides an insulated concrete form holder 10 for positioning the insulated concrete forms 12 that form the first course 40 of the wall 36, as shown in FIGS. 6 and 7, so that the first course of insulated concrete forms are formed integrally with the foundation 42 of the building 44. For ease of description, it should be understood that while the insulated concrete form holder 10 is described herein in connection with one particular foundation 42, it may be used with other foundations, footers or construction bases of a wide variety of constructions and designs. The foundation 42 is provided to support the walls 36 and the remainder of the building 44.

The foundation or footer form 46, shown in FIGS. 1, 4 and 5, is provided to form the foundation 42 and allow concrete to be poured into the form and harden and form the foundation. The foundation form 46 is provided along the length of the wall or walls 36 of the building to be constructed. The foundation form 46 may be of metal, wood, plastic, earth or other materials that constrain the concrete as it is poured into the foundation form and has a bottom 48 and opposing sides 50, 52 which extend upwardly to a top 54 which is spaced from the bottom of the foundation form a predetermined foundation depth distance 56. The foundation form 46 utilize the inner sides 58, 60 of the channel shaped drains 62, 64 to define the opposing sides 50, 52 of the foundation form 46. The bottom 48 of the foundation form is defined by the bottom 70 of a trench 74 in which the channel shaped drains 62, 64 are positioned.

The channel shape drains 62, 64 are rectangularly shaped tubes having inner sides 58, 60, outer sides 76 and top and bottom sides 78, 80 respectively. Channel reinforcing portions 82 are also provided between the inner side and the outer side to strengthen the drains. The outer sides 76 have a series of apertures 84 therethrough to allow water to flow into the drains 62, 64 and subsequently flow away from the foundation.

Figure 2:
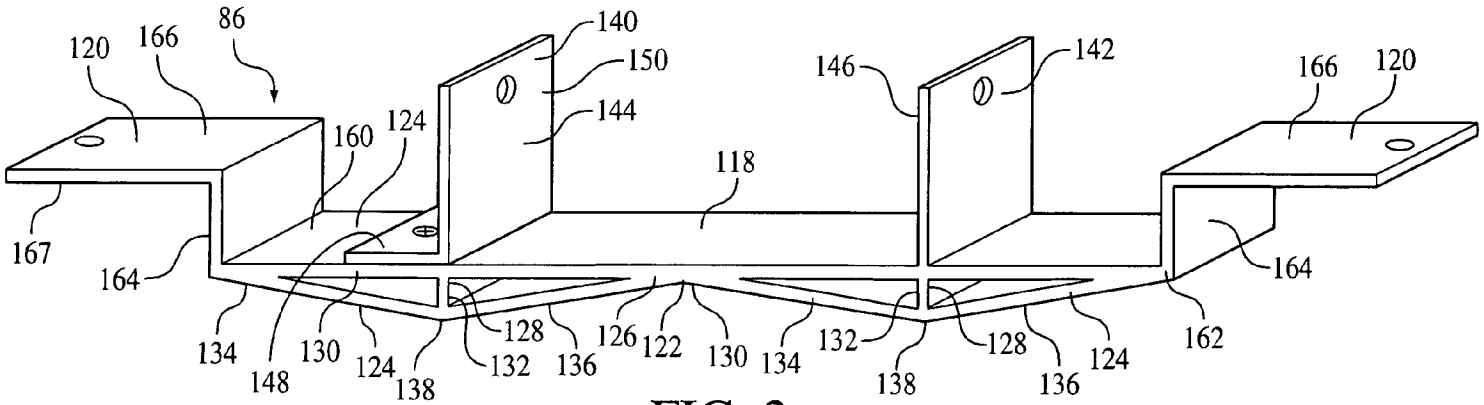
FIG. 2 is a perspective view of the top bracket of the form holder of the present invention shown in FIG. 1.
Figure 3:
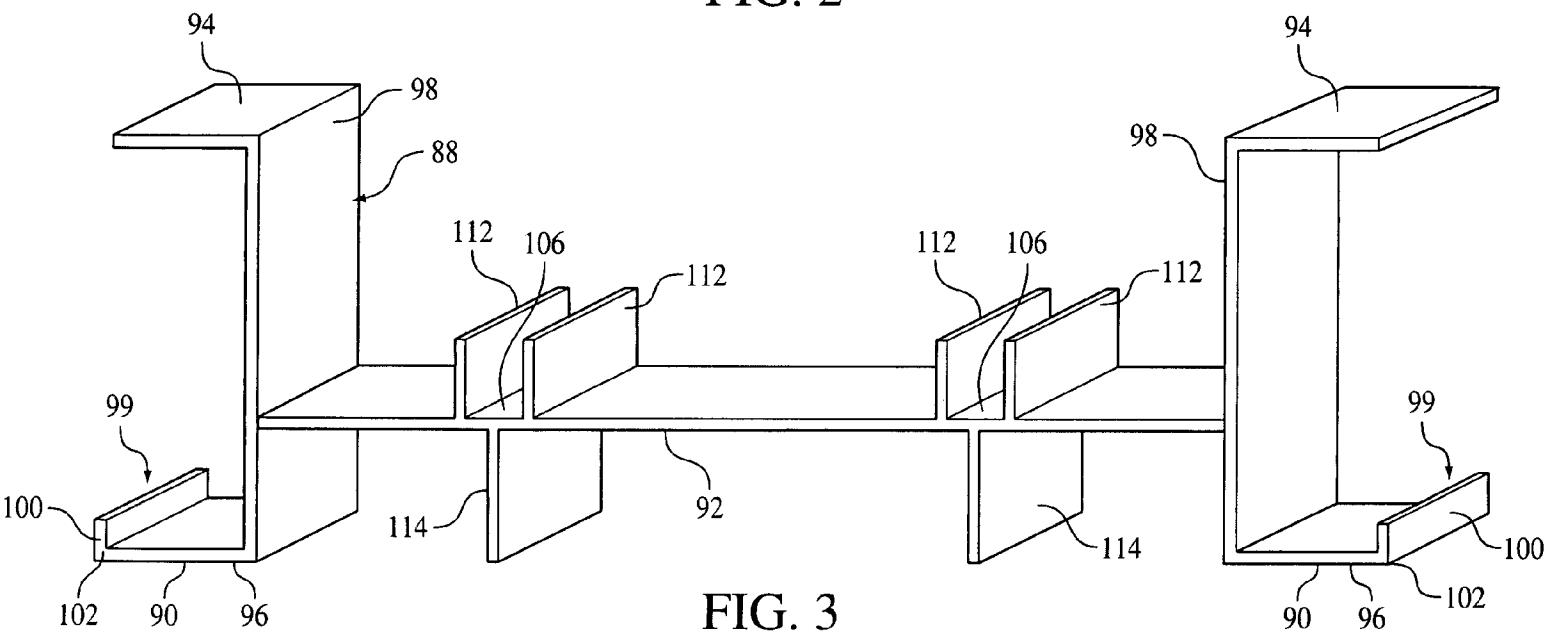
FIG. 3 is a perspective view of the bottom bracket of the form holder of the present invention shown in FIG. 1.

The insulated concrete form holder 10 of the present invention, shown in FIGS. 1-5, has an upper or top member 86 and a lower or bottom member 88. As seen in FIGS. 3 and 5, the bottom member 88 has end portions or drain holders 90 connected by a reinforcing support portion 92. The end portions 90 have a top and a bottom 94, 96 respectively which are interconnected with a side portion 98. The top, bottom, and side portions 94, 96 and 98, respectively, are formed to receive the channel shaped drains 62, 64.

During assembly of the bottom member 88 with the channel shape drains 62, 64, the top portion 94 of the bottom member engages the top 78 of the drains, the side portion 98 engages the inner sides 58, 60 of the drains, and the bottom portion 96 engages the bottom side 80 of the drain.

A fastening or securing device 99 is provided to secure the bottom member 88 to the drains 62, 64. The securing device includes a locking lip 100 is provided on the outer end 102 of the bottom portion 96 and extends upwardly along the outer side 96 of the channel shaped drain. The locking lip 100 allows the drain holders or end portions 90 of the bottom member 88 to be releasably assembled with the channel shaped drains 62, 64 so that they may be assembled with the drains in any desired location along the length of the drain.

It is desirable to reinforce the foundation 42 with various reinforcement materials, such as reinforcement metal bars, commonly known as "rebar", 104. The rebar is positioned a predetermined distance above the bottom of the foundation and is held in place while concrete is being poured and then harden to form the foundation. The present invention provides for supporting the rebar on a bar support surface 106 which is spaced above the bottom 108 of the foundation 42.

The bottom member 88 has a reinforcing support portion 92 which extends between the end portions 90 of the bottom member 88. The reinforcing support portion 92 has the bar support surface 106 to support the rebar 104 and is positioned a predetermined distance 110 upwardly above the bottom 108 of the foundation 42, as seen in FIG. 6. In order to further restrain movement of the rebar, the reinforcing support portion 92, as shown in FIGS. 1-5, has reinforcing bar upright portions 112 extending upwardly from the bar support surface 106 for receiving a reinforcing bar 104 therebetween. The bar support surface 106 and upright portions 112 are spaced along the length of the reinforcing support portion 92 so that the desired number of reinforcing metal bars 104 may be placed along the length of the foundation 42.

To support weight of the rebar 104 and the insulated concrete form holder 10 on the bottom 48 of the foundation form 46, the bottom member 88 has bottom support portions 114 extending downwardly from the reinforcing support portion 92 with bottom support surfaces 116 in contact with the bottom 48. The bottom support portions 114 extend downwardly a sufficient distance so that when the rebar 104 is positioned on the bar support surface 106, the rebar is positioned and supported at the predetermined distance 110 above the bottom 108 of the foundation 42. It should be understood that the support surface may contact any fixed surface that will provide for support of the bar support surface 106.

It is within the contemplation of this invention to support a variety of different reinforcing materials on the bottom member 88 and that the predetermined height at which the reinforcing material is positioned with respect to the bottom of the foundation may be varied as desired. Furthermore, it is within the contemplation of this invention to modify the design of the end portions 90 to be used in conjunction with foundation form members of a wide variety of constructions and designs including but not limited to wood, plastic, earth and metal forms. For example, the end portions 90 can be designed to be used in a trench where the bottom and sides of the trench constitute the foundation form or even when there is no trench and the foundation rests on flat earth. The end portions could also be modified to function with drains of differing shapes and configurations.

To position the insulated concrete forms 12, which form the first course 40 of a wall 36 so they are formed integrally with the foundation 42, the form holder 10 has a form support surface 118 for contacting the bottom 16 of the insulated form. The form support surface 118 is positioned between the top, bottom and sides 54, 48, 50, 52 respectively of the foundation form 46 and held in that position. The form support surface 118 is spaced from the top 54 of the foundation form 46 a distance less than the height 27 of the insulated concrete form 12 so the top 26 of the insulated concrete form is positioned above the top of the foundation. Additional insulated concrete forms may be positioned on top of the insulated concrete forms forming the first course of the wall.

As seen in FIGS. 2, 4, and 5, the top or upper member 86 of the form holder 10 has end portions 120 and an ICF support portion 122 extending between the opposing end portions 120. The ICF support portion 122 has the form support surface 118 and has reinforcing portions 124 to strengthen the support portion 122 and resist deflection of the form support surface when insulated concrete forms 12 are positioned on the support surface. The form support surface 118 is defined by the top 124 of the crossmember 126 extending between the opposing end portions 120. The support portion 122 also includes reinforcing portions 128 extending from the bottom 130 of the crossmember 126 to improve the strength of the ICF support portion 122.

The reinforcing portions 128 include a central portion 132 which extends downwardly from the bottom 130 of the cross member 126 and angle portions 134, 136 which extend downwardly from the bottom 130 at an angle and terminate at the bottom 138 of the central portion 132. These reinforcing portions 128 form a triangle below the bottom 130 of the crossmember 126 so that when a downward force is exerted on the form support surface 118, deflection of the form support surface is resisted. By so reinforcing the ICF support portion 122, when insulated concrete forms 12 are placed thereon as will be hereinafter described, and concrete is poured into the first course 40 and foundation form 46, the insulated concrete forms 12 are maintained in the position in which they are set so that they remain level and in alignment with each other.

The form holder 10 also includes form support upright portions 140, 142 which extend upwardly from the form support surface 118. These upright portions 140, 142 have form retaining surfaces 144, 146 extending upwardly from the form support surface for contacting the sides 18, 20 of the insulated concrete form 12. The form support upright portion 142 is formed integrally with the crossmember 126 and extends upwardly from the form support surface 118. The upright portion 142 is positioned along the length of the crossmember 126 so that the insulated concrete form 12, when positioned on the crossmember 126, is generally centrally located on the foundation. The form support upright portion 140 has a generally angular shape with a base 148 and an upright 150 and is adjustably secured to the crossmember as will hereinafter be more fully described.

The form holder 10 of the present invention may be used with insulated concrete forms having varying widths, that is the distance between the opposing sides 18, 20. To accommodate these varying widths, the form support upright portions 140, 142 are movable with respect to each other. When the desired insulated concrete form is selected, the upright portions 140, 142 are positioned on the form support surface so that the opposing sides 18, 20 of the insulated concrete form are positioned between the upright portions and the sides of the insulated concrete form and are in contact with the upright portions.

To position the upright portions 140, 142 on the crossmember, the width of the ICF, that is the distance between the opposing sides 18, 20, is measured. The upright portion 140 is positioned along the crossmember 126 so that the distance between the form retaining surfaces 144, 146 of the upright portions 140, 142 respectively are substantially equal to the width of the ICF. A fastening device 152 is provided to releasably secure the upright portion 140 in this position. The fastening device 152 includes a threaded fastener 154 extending through an aperture 156 in the base 148 and an aperture 158 extending through the crossmember 126. The aperture 158 is formed when the fastner 154, which is a self tapping fastner, is threaded into the crossmember. The threaded fastener 154 threadedly secures the base 148 and the crossmember 126 in the desired position. In this position, the sides 18, 20 of the ICF may be positioned in contact with the form retaining surfaces 144, 146 respectively and the bottom 16 of the ICF in contact with and supported by the form support surface 118. It is within the contemplation of this invention that both of the upright portions 140 and 142 are movably mounted on the form support surface and relesably secured thereto with fastening devices 152.

Accordingly, the insulated concrete forms 12 may be positioned in the foundation form 46 with their lateral movement restrained. It should be understood that when insulated concrete forms of a smaller width are used, the upright portions 140 is positioned closer to the upright portion 142 before being secured to the form support surface.

The end portions 120 of the upper member 86 are provided to support the upper member on the foundation form 46 so that the form support surface 118 is properly positioned on the foundation form. Each of the ends 160, 162 of the crossmember 126 have an end portion 120 extending therefrom. The end portions 120 have sides 164 extending upwardly from the crossmember ends 160, 162 and terminating in a top portion 166. When the top and bottom members 86, 88 of the form holder 10 are assembled, the sides 164 of the end portions 120 contact the side portions 98 of the end portions 90 of the bottom member 88 and the top portion 166 of the upper member 86 contacts the top 94 of the bottom member 88. The form holder support surface 167 of the top portion 166 contacts and is supported by the top 94. The form holder support surface 169 of the top, bottom, sides and locking lip, 94, 96, 98, and 100 of the end portions contact the foundation form 46 and the form support. It should be understood that the form holder 10 of the present invention, in a very basic form, may include a properly positioned form support surface 118 and a form holder support surface that holds the form support surface in that position. For example, the form holder support surface 167 may be formed and positioned to contact and be supported by the bottom 48 of the foundation form 46.

The foundation form 46 and the insulated concrete form holder 10 are assembled so that the form support surface 118 is spaced from the top 54 of the foundation form 46 a distance less than the height 27 of the insulated concrete form 12 so the top 26 of the insulated concrete form is positioned above the top of the foundation. In the embodiment disclosed in FIGS. 1-7, the trench 74 is dug in earth with opposing sides 168, 170 extending upwardly from the bottom 70 of the trench. The trench 74 is dug a sufficient width, or distance between the opposing sides 168, 170 so as to allow assembly of the foundation form 46 as described herein. It should be understood that the trench 74 may also be dug so that the opposing sides 168, 170 define the opposing sides of the foundation form in the case where, for example when channel shape drains are not used. Furthermore, depending on the configuration of the foundation form a trench may need not be necessary for the use of the present invention.

The channel shaped drains 62, 64 are then placed in the trench 74 and the inner sides 58, 60 are positioned facing each other, while the outer sides 76 with the apertures 84 therein face outwardly towards the sides 168, 170 of the trench. Bottom members 88 of the form holder 10 are then positioned along the length of the drains 62, 64 so that there are a sufficient number of form supports 10 space along the drains to support the first course of insulated concrete forms 12. The form holders 10 are positioned so that when the insulated concrete forms 12 are positioned thereon, the mounting strips 34 on the forms are in alignment with the form supports, as seen in FIG. 7. The bottom members 88 are then assembled with the drains by positioning the bottom side 80 of the drains adjacent to bottom 96 of the bottom member 88 and with the outer side 76 of the drain adjacent the locking lip 100 as can be seen in FIGS. 1-5. The channel shape drain is then moved into position so that the top 78 of the drain is adjacent the top 94 of the bottom member 88 with the inner side, 58, 60, as the case may be, adjacent to side portion 98 of the bottom member 88.

The channel shaped drains 62, 64 are then aligned in the trench. During this process of assembling the drain conduits 62, 64 and bottom member 88 of the form holder 10, the entire assembly is leveled to the proper elevation since this step will determine the proper elevation when topping out the wall. Such devices as a laser may be used to accomplish this leveling process.

The rebar 104 is then positioned on the bar support service 106 and between the reinforcing bar upright portions 112. When the rebar 104 is so positioned, the bottom support surface 116 of the reinforcing bar upright portions 112 are in contact with the bottom 48 of the foundation form which is also the bottom 70 of the trench. Accordingly the rebar is supported a predetermined distance from the bottom 48 of the foundation form.

After the drains and the bottom members 88 have been leveled and secured, the top members 86 of the form holders 10 are then positioned with respect to their respective bottom members 88 along the drains so that the sides 164 of the end portions 120 contact the side portions 98 of the end portions 90 of the bottom member 88 and the top portion 166 of the upper member 86 contacts the top 94 of the bottom member 88.

A fastening device 174 is provided to secure the top and bottom members 86, 88 of the form holder 10 to the channel shaped drains 62, 64. The fastening device 174 includes a threaded fastner 176 extending through and threadedly engaging aperture 178 in the top portion 166 of the upper member 86, aperture 180 in the top 94 of the bottom member 88 and aperture 182 in the top side 78 of the channel shaped and drains. The aperture 182 is formed when the fastner 176, which is a self tapping fastner, is threaded into the drains. The fastening device 174 maintains the relative positions between the channel shape drains 62, 64 and the form holder 10.

A fastening device 184 is provided to secure the assembly of the drains 62, 64 and the form holder 10 to resist movement of that assembly during the pouring and curing of concrete therein as will be hereinafter more fully described. The fastening device 184 includes an aperture 186 in the top portion 166 of the upper member 86. The fastening device 184 includes a metal bar 188 which slides through the aperture 186 and is driven into the bottom of the trench. The aperture 186 is positioned so that the metal bar 188 is adjacent the outer sides 76 of the channel shaped drains and the locking lip 100 so as to resist movement thereof.

Wash gravel 190 is then placed between the outer side 76 of the drains 62, 64 and their respective opposing sides 168, 170 of the trench 74, as seen in FIG. 6. The wash gravel 190 is provided to allow water along the inside or outside of the foundation 42 to flow into the drains 62, 64 and subsequently flow away from the foundation. This step is taken prior to placement of the insulated concrete forms 12 on the form holders 10 to avoid accidental bumping of the insulated concrete forms which may cause misalignment or damage the forms when placing the wash gravel therebetween.

The first course 40 of insulated concrete forms 10 are then positioned on the form support surface 118 of the form holder 10 and between the form support upright portions 140, 142 and in contact with the form retaining surfaces 144, 146 respectively. As seen in FIGS. 4,-7, the bottom 16 of the insulated concrete form 12 is in contact with the form support surface 118 so that so the top 26 of the insulated concrete form is positioned above the top 54 of the foundation. The bottom 16 of the insulated concrete form 12 is positioned a distance 192 below the top 194 of the foundation 42. The distance 192 is less than the height 27 of the insulated concrete form 12. As described above, the form holders 10 are positioned along the drains so that the mounting strips 34 of the insulated concrete forms 12 are adjacent the form upright portions 140, 142 when they are positioned thereon. The first course 40 of insulated concrete forms are leveled so that their tops 26 are in alignment with each other and level and properly positioned to define the location of the wall 36. Various leveling devices may be used, such as shims, to level the insulated concrete forms.

Once the insulated concrete forms are leveled and in alignment with each other, they are secured to the insulated concrete form holders 10. A fastening device 196 is provided to releasably secure the first course 40 of the insulated concrete forms 12 to the form holders 10. The fastening device 196 includes threaded fasteners 198 received in the apertures 200 or 202 in the upright portions 140, 142 respectively. For example, a threaded faster 198 is positioned in the aperture 200 and threaded into the adjacent mounting strip 34 of the insulated concrete form 12. The fastner 198, which is a self tapping fastner, forms its own aperture in the form holders. Likewise, on the other side of the insulated concrete form, a threaded fastner 198 is positioned in the aperture 202 and threaded into the adjacent mounting strip 34 of the insulated concrete form. The releasable securement of the insulated concrete forms 12 and the form holders 10, allows for adjustment therebetween during the leveling process. This method of attachment allows the form 12 to be attached to the form holder 10 without relative movement therebetween and also accommodates any adjustment required by the prior leveling process To reinforce the wall 40 and increase strength of the attachment between the wall and the foundation 42, a series of metal reinforcement bars 204, shown in FIGS. 6 and 7, are positioned vertically through the apertures 28 in the insulated concrete form 12 and into the foundation form 46. The bottoms 206 of the reinforcement bars 204 are bent as seen in FIGS. 6 and 7 to increase the holding strength of the bars 204 in the foundation. In these metal reinforcement bars 204 are secured in this position.

Concrete is then poured into the apertures 28 in the insulated concrete forms 12 forming the first course 40. The concrete flows through the apertures in the forms and into the foundation form 46. As additional concrete is supplied, the foundation form 46 is filled until the concrete reaches the top 54 of the foundation form 46. The concrete surrounds a bottom portion 208 of the insulated concrete form and a bottom portion 210 of the aperture 28 of the insulated concrete form 12. The concrete is then allowed to hardened and cure both in the foundation form 46 and inside a portion of the apertures 28 in the first course 40 of the insulated concrete forms 12. Accordingly, the first course of insulated concrete forms are formed integrally with the foundation of the building.

The other insulated concrete forms may then be installed to the desired height and braced as needed. Vertical and horizontal rebar is installed as the forms are set up and braced. Concrete is then poured into the apertures in these additional concrete forms in the unfilled portion of the apertures and the first course of concrete forms and allowed to harden and cure.

It is within the contemplation of this invention that the components of the form holders 10 may be of a wide variety of constructions and designs. For example, where appropriate, the form holder 10 may include only the upper member 86, with the rebar held in position with known wire forms and the end portions 120 designed to accommodate various foundation forms. The end portions 120 of the form holder may be readily designed to support the form support surface 118 in a position that holds the first course of insulated concrete forms so that they are formed integrally with the foundation. While in the embodiment described herein, the form holder 10 is made from extruded plastic, it is within the contemplation of this invention to provide a form holder from a wide variety of materials that holds the first course of insulated concrete forms so that they are formed integrally with the foundation.

The invention has been described with reference to the preferred embodiment. Obviously, modifications and alterations will occur to others upon reading and understanding the specification. It is our intention to include all modifications and alterations in so far as they are within the scope of the appended claims or equivalents thereof.

I claim:

1. An insulated concrete form holder for positioning an insulated concrete form in a foundation form to form a structural element of a building, the insulated concrete form has a bottom, opposing sides, and a top spaced from the bottom a predetermined form height, the foundation form has a bottom, opposing sides, and a top spaced from the bottom a predetermined foundation depth distance, said insulated concrete form holder including:

an insulated concrete form holder support surface adapted to support said insulated concrete form holder in the foundation form, an insulated concrete form support surface (a) in operative association with said insulated concrete form holder support surface, (b) adapted to contact the insulated concrete form, (c) adapted to support the insulated concrete form thereon, (d) positionable between the top and the bottom of the foundation form, and (e) spaced from the top of the foundation form a distance less than the height of the insulated concrete form so that the top of the insulated concrete form is positionable above the top of the foundation form, and an insulated concrete form support upright portion extending upwardly from said insulated concrete form support surface, said insulated concrete form support upright portion having at least one form retaining surface adapted to contact a side of the insulated concrete form and restraining movement of the insulated concrete form, said insulated concrete form holder support surface, said insulated concrete form support surface and said insulated concrete form support upright portion are permanent part of the structural element of the building.

2. An insulated concrete form holder, as described in claim 1, wherein said form holder has a reinforcing bar support surface adapted to support a reinforcing bar thereon.

3. An insulated concrete form holder, as described in claim 2, wherein said reinforcing bar support surface is positioned below said form support surface.

4. An insulated concrete form holder, as described in claim 2, wherein said insulated concrete form holder has at least one reinforcing bar upright portion extending upwardly from said reinforcing bar support surface.

5. An insulated concrete form holder, as described in claim 4, wherein said insulated concrete form holder has a plurality of reinforcing bar upright portions for receiving a reinforcing bar therebetween.

6. An insulated concrete form holder, as described in claim 1, wherein said insulated concrete form holder has a plurality of form support upright portions for receiving the sides of the insulated concrete form therebetween.

7. An insulated concrete form holder, as described in claim 6, wherein at least one of said form support upright portions is movable with respect to the other of said form support upright portions, said insulated concrete form holder having at least one fastening device for releasably securing said one form support upright portion with respect to said other form support upright portion.

8. An insulated concrete form holder, as described in claim 1, wherein said insulated concrete form holder includes a fastening device adapted to secure the insulated concrete form to said form support upright portion.

9. An insulated concrete form holder, as described in claim 1, wherein said insulated concrete form holder includes a fastening device adapted to secure said insulated concrete form holder to the foundation form.

10. An insulated concrete form holder, as described in claim 1, wherein said insulated concrete form holder includes a fastening device adapted to secure a drain to said insulated concrete form holder.

11. An insulated concrete form holder, as described in claim 1, wherein said insulated concrete form holder has a bottom member with a bottom support surface and an upper member having said insulated concrete form support surface and said form support upright portion, and a fastening device for releasably securing said bottom member and said upper member of said insulated concrete form holder to each other.

12. An insulated concrete form holder, as described in claim 11, wherein said insulated concrete form holder has a reinforcing portion for strengthening said bottom support surface.

13. An insulated concrete form holder, as described in claim 1, wherein said insulated concrete form holder has a bottom support surface adapted to contact the bottom of the foundation form and supporting said insulated concrete form holder.

14. An insulated concrete form holders as described in claim 13, wherein said insulated concrete form support surface is spaced upwardly from said bottom support surface and is adapted to contact the bottom of the insulated concrete form and supporting the insulated concrete form thereon.

15. An insulated concrete form holders as described in claim 13, wherein said insulated concrete form support surface is spaced from the bottom support surface a distance less than the foundation depth distance.

16. An insulated concrete form holder, as described in claim 13, wherein said insulated concrete form holder has a reinforcing bar support surface spaced above said bottom support surface.

17. A method for positioning insulated concrete forms in a foundation form and forming the insulated concrete forms integrally with a foundation including the steps of:

positioning a plurality of insulated concrete form holders in a foundation form with the insulated concrete form support surface of the insulated concrete form holders supported in the foundation form and below the top of the foundation form, positioning at least one course of insulated concrete forms with (a) the bottom of the insulated concrete forms in contact with and supported by the insulated concrete form support surface of the insulated concrete form holder, and (b) the top of the insulated concrete form positioned above the top of the foundation form, and pouring concrete into the foundation form until a bottom portion of the at least one course of insulated concrete forms is surrounded by the concrete.

18. A method for positioning insulated concrete forms in a foundation form and forming the insulated concrete forms integrally with a foundation, as described in claim 17, which includes the step of positioning a plurality of reinforcing bars on the reinforcing bar support surface of the insulated concrete form holders so that the reinforcing bars are spaced a predetermined distance from the bottom of the foundation form before said step of positioning at least one course of insulated concrete forms.

19. A method for positioning insulated concrete forms in a foundation form and forming the insulated concrete forms integrally with a foundation, as described in claim 18, in which said step of positioning a plurality of reinforcing bars on the reinforcing bar support surface includes the step of positioning one reinforcing bar between reinforcing bar upright portions on the insulated concrete form holder extending upwardly from the bar support surface.

20. A method for positioning insulated concrete forms in a foundation form and forming the insulated concrete forms integrally with a foundation, as described in claim 17, in which said step of positioning at least one course of insulated concrete forms includes the step of positioning the sides of the one insulated concrete form adjacent a form support upright portion extending upwardly from the bottom support surface.

21. A method for positioning insulated concrete forms in a foundation form and forming the insulated concrete forms integrally with a foundations as described in claim 20, which includes the step of securing the insulated concrete form to the form support upright portion after said step of positioning at least one course of insulated concrete forms.

22. A method for positioning insulated concrete forms in a foundation form and forming the insulated concrete forms integrally with a foundations as described in claim 21, which includes the steps of adjusting another form support upright portion to a position adjacent the other side of the insulated concrete form, and securing the other form support upright portion to the form support surface before said step of positioning at least one course of concrete forms.

23. A method for positioning insulated concrete forms in a foundation form and forming the insulated concrete forms integrally with a foundations as described in claim 17, in which said step of pouring concrete into the foundation form includes the step of pouring the concrete through an aperture in the insulated concrete form into the foundation form.

24. A method for positioning insulated concrete forms in a foundation form and forming the insulated concrete forms integrally with a foundation, as described in claim 17, including the step of securing the insulated concrete form holders in place after said step of positioning a plurality of insulated concrete form holders in a foundation form.

25. A method for positioning insulated concrete forms in a foundation form and forming the insulated concrete forms integrally with a foundation, as described in claim 17, wherein said step of positioning a plurality of insulated concrete form holders in a foundation form includes the step of positioning a plurality of insulated concrete form holders on a drain conduit.

* * * * *